US007849666B2

(12) United States Patent
Kirth et al.

(10) Patent No.: US 7,849,666 B2
(45) Date of Patent: Dec. 14, 2010

(54) CORE-SHEATH ROPE

(75) Inventors: Rudolf Kirth, Vocklabruck (AT); Erich Ruhrnossl, Ansfelden (AT)

(73) Assignee: Teufelberger Gesellschaft M.B.H. (AT)

( * ) Notice: Subject to any disclaimer, the term of this patent is extended or adjusted under 35 U.S.C. 154(b) by 134 days.

(21) Appl. No.: 12/293,832

(22) PCT Filed: Mar. 30, 2007

(86) PCT No.: PCT/AT2007/000150

§ 371 (c)(1),
(2), (4) Date: Oct. 3, 2008

(87) PCT Pub. No.: WO2007/112468

PCT Pub. Date: Oct. 11, 2007

(65) Prior Publication Data

US 2009/0320436 A1 Dec. 31, 2009

(30) Foreign Application Priority Data

Mar. 31, 2006 (AT) ..... A 557/2006
Jun. 28, 2006 (AT) ..... A 1089/2006

(51) Int. Cl.
*D02G 3/02* (2006.01)

(52) U.S. Cl. ..... 57/210

(58) Field of Classification Search ..... 57/210, 57/230, 232, 234
See application file for complete search history.

(56) References Cited

U.S. PATENT DOCUMENTS

| | | | | |
|---|---|---|---|---|
| 4,640,178 | A * | 2/1987 | Kurzbock | 87/6 |
| 5,176,862 | A | 1/1993 | Hogenboom et al. | |
| 5,358,262 | A * | 10/1994 | Roberts | 277/652 |
| 6,283,004 | B1 * | 9/2001 | Tseng | 87/6 |
| 2005/0011344 | A1 | 1/2005 | Hess | |

FOREIGN PATENT DOCUMENTS

| | | |
|---|---|---|
| EP | 1430176 | 5/2006 |

* cited by examiner

*Primary Examiner*—Shaun R Hurley
(74) *Attorney, Agent, or Firm*—Lowe Hauptman Ham & Berner, LLP

(57) ABSTRACT

The invention relates to a rope made of a textile fibre material and present in the form of a core-sheath structure in a manner known per se. The rope according to the invention is characterized in that the specific strength of the rope $F_s$ (in [daN/g core/m rope]) complies with the following formula depending on the diameter of the rope DM (in [mm]): $F_s$>212−DM.

35 Claims, No Drawings

CORE-SHEATH ROPE

CROSS-REFERENCE TO RELATED APPLICATIONS

The present Application is based on International Application No. PCT/AT07/000,150, filed on Mar. 30, 2007, which in turn corresponds to Austria Application Nos. A 1089/2006, filed on Jun. 28, 2006, and A 557/2006, filed on Mar. 31, 2006, and priority is hereby claimed under 35 USC §119 based on these applications. Each of these applications are hereby incorporated by reference in their entirety into the present application.

FIELD OF THE INVENTION

The present invention relates to a rope made of a textile fibre material.

BACKGROUND OF THE INVENTION

In the field of agriculture and forestry and in the building and transport industries, steel ropes are usually used as hauling ropes, carrying ropes and the like for rope devices, e.g., rope pole devices or winches.

High demands are made on ropes in this application area particularly with regard to their tensile strength and their abrasion resistance, since the ropes are guided, for example, on forest soil and over tree trunks.

What is also desirable is easy determinability of the replacement state of wear, i.e., of the point in time when the rope has to be replaced as a preventive measure because of too much damage sustained in the ongoing operation.

For the above reasons, mainly steel ropes are currently used for said purposes, as already mentioned initially, since, on the one hand, they exhibit high tensile strength and, on the other hand, they are also highly resistant to abrasion.

However, the disadvantage of steel ropes is their large weight. This is disadvantageous in particular when ropes must be retracted manually, for example, for mounting tower yarders.

Therefore, attempts have already been made to use ropes made of a textile fibre material in the field of agriculture and forestry. Sheathless ropes made of a high-strength textile fibre material (e.g., of Dyneema® fibres, a high-strength and high-modulus polyethylene (HMPE) fibre material) are known.

If, however, a rope made of a textile fibre material is supposed to achieve equally high tensile strengths like a steel rope, the individual fibres have to be oriented in the rope direction to the largest possible extent, i.e., twines and cords, respectively, with a small twist and a large length of lay, respectively, have to be used. This, however, happens at the expense of abrasion resistance. In addition, it is difficult to determine the replacement state of wear of such ropes.

It is the object of the present invention to provide a rope made of a textile fibre material which is particularly suitable for use in rope devices of all kinds, especially winches, and does not exhibit the above-mentioned disadvantages.

Said object is achieved by a rope made of a textile fibre material and present in the form of a core-sheath structure in a manner known per se, which rope is characterized in that the specific strength of the rope $F_s$ (in [daN/g core/m rope]) complies with the following formula depending on the diameter of the rope DM (in [mm]):

$$F_s \geqq 212 - DM.$$

Ropes made of a textile fibre material which are present in the form of a core-sheath structure are known per se. Such a rope is made up of one or several, e.g., braided or beaten core(s) of a textile fibre material, with a textile fibre material being wrapped, e.g., braided, around said core(s) as a sheath.

For the purposes of the present invention, the term "core" denotes hereafter both a single core and a plurality of cores present in a rope.

Ropes having a core-sheath structure are indeed commonly used in many areas such as, e.g., in the field of mountaineering or nautics, but so far have not been suggested for the sector of rope devices in agriculture and forestry. This is due to various reasons:

For one thing, substantially higher tensile loads are effective in the present field of application, which tensile loads have to be transmitted to the core via the sheath. Even minor displacements between the core and the sheath will lead to poor force transmission and to the sheath being slid open. The rope will thus become susceptible to abrasion and, in addition, will exhibit a lump at the respective spot, which lump will be put under even greater stress. All this will eventually result in the destruction of the rope.

SUMMARY OF THE INVENTION

The invention now provides for the first time a textile rope having a core-sheath structure which exhibits similarly good tensile strengths and abrasion resistance like a steel rope of comparable thickness.

Thereby, the diameter DM of the rope according to the invention preferably ranges from 4 to 60 mm, preferably from 4 to 40 mm, particularly preferably from 4 to 26 mm.

Preferably, the core of the rope according to the invention has been stretched to an extent of more than 5%, preferably 5.5% to 20%, particularly preferably 6% to 15%, of the core's maximum tensile force. The core of conventional ropes having a core-sheath structure has usually been stretched only to a range of up to 5% of the maximum tensile force.

It has thereby proven to be advantageous if the stretching of the core is performed at a temperature higher than room temperature, in particular at an ambient temperature of up to the melting range or decomposition range, respectively, of the respective polymer used as the fibre material of the core. A person skilled in the art is able to determine the temperature ranges suitable for the respective fibre material of the core based on his or her expert knowledge. With cores made of an HMPE fibre material (e.g., Dyneema® fibres), an ambient temperature of from 50° C. to 140° C., preferably from 90° C. to 120° C., is preferred.

The diameter of a core, which, according to the invention, is preferably highly stretched, is reduced as compared to those of cores which have been stretched to a lesser extent. It thereby becomes possible to obtain a rope which is not substantially thicker than a steel rope having the same tensile strength, despite the application of a sheath onto the core. At the same time, the sheath guarantees protection of the core and an improved abrasion resistance, as compared to a rope consisting exclusively of a core of high-strength fibres.

Furthermore, due to the high stretching of the rope's core as preferred according to the invention, no further reduction in the diameter of the core will occur when using the rope. A displacement between the sheath and the core can thereby largely be avoided.

Preferably, the fibre material of the core is selected from the group consisting of high-strength fibres, in particular high-strength high-modulus polyethylene fibres, aramide fibres, liquid crystal (LC) polyester fibres, polybenzoxazole fibres and mixtures thereof.

High-strength high-modulus polyethylene fibres are commercially available under the brand name Dyneema®. LC polyester fibres are commercially available under the brand name Vectran®.

Also preferably, the fibre material of the sheath is selected from the group consisting of highly abrasion resistant fibres, in particular high-strength high-modulus polyethylene fibres, liquid crystal (LC) polyester fibres, other abrasion resistant polyester fibres, polyamide fibres and mixtures thereof.

The rope according to the invention preferably comprises means for increasing the adhesion between the core and the sheath of the rope.

For this purpose, at least a portion of the core's surface can be wrapped with a material selected from the group consisting of staple fibre yarns and textured multifilament yarns. In a manner known per se, said wrapping can, for example, be present in the form of a reinforcement, a surrounding braid or in the form of fibres with increased adhesion which have been braided along with the core and are located at least partly at the surface thereof.

Particularly polyamide, polyester, polyacrylate, polypropylene, polyethylene and mixtures thereof are suitable as materials for the wrapping.

In order to increase the adhesion between the core and the sheath, seams can be provided between those components.

As an alternative or in addition to the already mentioned possibilities of increasing the adhesion between the core and the sheath, at least a portion of the core's surface can be coated with an adhesion increasing substance.

Also the sheath itself or the rope elements forming the sheath, respectively, such as, e.g., yarns or twines, can be coated with an adhesion increasing substance.

The rope according to the invention provides several possibilities for detecting damage as a result of which the rope has to be regarded as ready to be discarded:

For example, damage to the rope can easily be detected by checking the condition of the sheath: As soon as parts of the core become visible, the rope has to be replaced.

Indications of fatigue of a rope's core are, on the one hand, a thinning of the rope and, on the other hand, an elongation of the rope.

With the rope according to the invention, thinning of the rope involves a loosening of the sheath, which can be detected manually.

In a preferred embodiment of the rope according to the invention, the sheath has marks based on which an elongation of the rope and/or a twisting of the rope is/are detectable.

The marks may, for example, be placed at fixed distances. If the sheath contains marks placed at fixed distances (e.g., individual differently coloured braided diamonds at a fixed distance of in each case, e.g., 10 cm), it is possible to check before using the rope as to whether said distance has changed, especially increased, which points to an elongation of the rope and thus to a replacement state of wear.

It can also be determined by means of a pattern of marks (e.g., a striped pattern or other marks in the longitudinal direction of the rope) as to whether the rope has twisted during use, which is detectable from a distortion of the original pattern. A twisting of the rope is disadvantageous and significantly reduces the tensile strength of the rope. It is thus necessary to turn it back into the original, i.e., twist-free form of the rope.

The rope according to the invention is particularly suitable for use in rope devices, particularly in the field of agriculture and forestry and in the building and transport industries. With the rope according to the invention, an equivalent alternative to steel ropes, but with a much smaller weight (typically, a rope according to the invention has a weight of merely about 20% of the weight of a comparable steel rope), can for the first time be made available.

In particular, the rope according to the invention is suitable as a carrying rope, a stay rope, a hauling rope, a hoisting rope, a return rope or a logging rope in rope devices, pole rope devices and winches according to the definitions used, for example, in the Austrian Standards L 5219 and L 5276 with regard to mobile rope devices for timber hauling and logging winches for agriculture and forestry, respectively.

A preferred process for the production of the rope according to the invention comprises the manufacture of a rope core made of a textile fibre material and the wrapping of the rope core with a sheath made of a textile fibre material and is characterized in that the rope core is stretched to an extent of more than 5%, preferably 5.5% to 20%, particularly preferably 6% to 15%, of the core's maximum tensile force before it is wrapped with the sheath.

The stretching of the core can preferably be performed at a temperature higher than room temperature, in particular at an ambient temperature of up to the melting range or decomposition range, respectively, of the respective polymer used as the fibre material of the core.

DETAILED DESCRIPTION OF THE INVENTION

If the fibre material of the core consists of high-strength high-modulus (HMPE) polyethylene fibres, the stretching of the core can preferably be performed at an ambient temperature of from 50° C. to 140° C., particularly preferably from 90° C. to 120° C.

Examples

Example 1

Comparative Example

A rope consisting merely of a core of Dyneema® fibres was tested.

Example 2

According to the Invention

A choker rope comprising a core of Dyneema® fibres, a wrapping (an intermediate sheath of polyester fibres) and a sheath of Dyneema® fibres was produced according to the following structure:

Core: Dyneema® SK75; 12-plait braid:

dtex 1760×15/20S—2-fold×6 dtex 1760×15/20Z—2-fold×6

The core was stretched at 100° C. to an extent of 5.5% of the maximum tensile force.

Intermediate sheath: Polyester staple fibre yarn; 16-plait braid:

Nm 5.3—3-fold×16

Sheath: Dyneema® SK 75; 32-plait braid:

dtex 1760×3/100S—2-fold×16 dtex 1760×3/100Z—2-fold×16

Example 3

According to the Invention

A choker rope comprising a core of Dyneema® fibres, a wrapping (an intermediate sheath of polyester fibres) and a sheath of Vectran® fibres was produced according to the following structure:

Core: Dyneema® SK75; 12-plait braid:

dtex 1760×15/20S—2-fold×6 dtex 1760×15/20Z—2-fold×6

The core was stretched at 100° C. to an extent of 5.5% of the maximum tensile force.

Intermediate sheath: Polyester staple fibre yarn; 16-plait braid:

Nm 5.3—3-fold×16

Sheath: Vectran®; 32-plait braid:

dtex 1670×5/70S—2-fold×16 dtex 1670×4/70Z—2-fold×16

Example 4

According to the Invention

A stay rope comprising a core of Dyneema® fibres and a sheath of polyester fibres was produced according to the following structure:

Core: Dyneema® SK75; 12-plait braid:

dtex 1760×11/20S—×10/10Z×6 dtex 1760×11/20Z—×10/10S×6

The core was stretched at 120° C. to an extent of 10% of the maximum tensile force.

Sheath: Polyester multifilament yarn; 32-plait braid:

dtex 1100×12/70S—3-fold×16 dtex 1100×12/70Z—3-fold×16

Example 5

According to the Invention

A fitting rope comprising a core of Dyneema®, an adhesion increasing impregnation applied to the core and a sheath of polyester fibres was produced according to the following structure:

Core: Dyneema® SK75; 12-plait braid:

dtex 1760×7/20S—1-fold×6 dtex 1700×7/20Z—1-fold×6

The core was stretched at 110° C. to an extent of 5.5% of the maximum tensile force.

In addition, the core was impregnated with a polyurethane based impregnation immediately before the sheath was braided around it.

Sheath: Polyester multifilament yarn; 32-plait braid:

dtex 1100×12/70S—3-fold×16 dtex 1100×12/70Z—3-fold×16

In the ropes produced in Examples 1 to 5, the maximum tensile force (HZK) was measured and correlated to the respective diameter of the rope and to the respective core weight, respectively.

The results of those tests are summarized in the following table:

| Example no.: | diameter [mm] | HZK [daN] | weight core [g core/m rope] | specific strength $F_S$ [daN/(g core/m rope)] |
|---|---|---|---|---|
| 1 | 16.0 | 22,000 | 140 | 157.0 |
| 2 | 15.1 | 13,330 | 66.6 | 200.2 |
| 3 | 15.1 | 13,120 | 66.6 | 197.0 |
| 4 | 26.5 | 45,900 | 247 | 185.8 |
| 5 | 9.6 | 3,861 | 15.4 | 250.7 |

It is evident from the table that all of the ropes according to the invention (Examples 2 to 5) have a significantly higher specific strength than a rope consisting exclusively of a core of Dyneema® fibres.

The invention claimed is:

1. A rope made of a textile fibre material and present in the form of a core-sheath structure wherein the specific strength of the rope $F_s$ ([daN/(g core/m rope)]) complies with the following formula depending on the diameter of the rope DM (in [mm]):

$$F_s \geqq 212-DM.$$

2. The rope according to claim 1, wherein the diameter DM of the rope ranges from 4 to 60 mm.

3. The rope according to claim 1, wherein the core of the rope has been stretched to an extent of more than 5% of the core's maximum tensile force.

4. The rope according to claim 1, wherein the fibre material of the core is selected from the group consisting of high-strength fibres.

5. The rope according to claim 1, wherein the fibre material of the sheath is selected from the group consisting of highly abrasion resistant fibres.

6. The rope according to claim 1, comprising means for increasing the adhesion between the core and the sheath of the rope.

7. The rope according to claim 6, wherein at least a portion of the core's surface is wrapped with a material selected from the group consisting of staple fibre yarns and textured multifilament yarns.

8. The rope according to claim 6, wherein seams are provided between the core and the sheath.

9. The rope according to claim 6, wherein at least a portion of the core's surface is coated with an adhesion increasing substance.

10. The rope according to claim 1, wherein the sheath has marks based on which an elongation of the rope and/or a twisting of the rope is/are detectable.

11. A process for the production of a rope, comprising the manufacture of a rope core made of a textile fibre material and the wrapping of the rope core with a sheath made of a textile fibre material, wherein the rope core is stretched to an extent of more than 5% of the core's maximum tensile force before it is wrapped with the sheath, and wherein the rope is made of a textile fibre material and present in the form of a core-sheath structure wherein the specific strength of the rope $F_s$ ([daN/(g core/m rope)]) complies with the following formula depending on the diameter of the rope DM (in [mm]):

$$F_s \geqq 212-DM.$$

12. The process according to claim 11, wherein the stretching of the core is performed at a temperature higher than room temperature.

13. The process according to claim 11, wherein the fibre material of the core consists of high-strength high-modulus polyethylene fibres and the stretching of the core is performed at an ambient temperature ranging from 50° C. to 140° C.

14. The rope according to claim 2, wherein the core of the rope has been stretched to an extent of more than 5% of the core's maximum tensile force.

15. The rope according to claim 7, wherein seams are provided between the core and the sheath.

16. The rope according to claim 7, wherein at least a portion of the core's surface is coated with an adhesion increasing substance.

17. The rope according to claim 8, wherein at least a portion of the core's surface is coated with an adhesion increasing substance.

18. The process according to claim 11, wherein the diameter DM of the rope ranges from 4 to 60 mm.

19. The process according to claim 11, wherein the fibre material of the sheath is selected from the group consisting of highly abrasion resistant fibres.

20. The process according to claim 11, wherein at least a portion of the core's surface is coated with an adhesion increasing substance.

21. The rope according to claim 1, wherein the diameter DM of the rope ranges from 4 to 40 mm.

22. The rope according to claim 1, wherein the diameter DM of the rope ranges from 4 to 26 mm.

23. The rope according to claim 1, wherein the core of the rope has been stretched to an extent ranging from 5.5% to 20% of the core's maximum tensile force.

24. The rope according to claim 1, wherein the core of the rope has been stretched to an extent ranging from 6% to 15% of the core's maximum tensile force.

25. The rope according to claim 1, wherein the fibre material of the core is selected from the group consisting of high-strength high-modulus polyethylene fibres, aramide fibres, liquid crystal (LC) polyester fibres, polybenzoxazole fibres and mixtures thereof.

26. The rope according to claim 1, wherein the fibre material of the sheath is selected from the group consisting of high-strength high-modulus polyethylene fibres, liquid crystal (LC) polyester fibres, other abrasion resistant polyester fibres, polyamide fibres and mixtures thereof.

27. A process for the production of a rope according to claim 11, wherein the rope core is stretched to an extent ranging from 5.5% to 20% of the core's maximum tensile force before it is wrapped with the sheath.

28. A process for the production of a rope according to claim 11, wherein the rope core is stretched to an extent ranging from 6% to 15% of the core's maximum tensile force before it is wrapped with the sheath.

29. The process according to claim 11, wherein the stretching of the core is performed at a temperature ranging from ambient temperature to either the melting range or decomposition range, respectively, of the respective polymer used as the fibre material of the core.

30. The process according to claim 11, wherein the fibre material of the core consists of high-strength high-modulus polyethylene fibres and the stretching of the core is performed at an ambient temperature ranging from 90° C. to 120° C.

31. The rope according to claim 2, wherein the core of the rope has been stretched to an extent ranging from 5.5% to 20% of the core's maximum tensile force.

32. The rope according to claim 2, wherein the core of the rope has been stretched to an extent ranging from 6% to 15% of the core's maximum tensile force.

33. The process according to claim 11, wherein the diameter DM of the rope ranges from 4 to 40 mm.

34. The process according to claim 11, wherein the diameter DM of the rope ranges from 4 to 26 mm.

35. The process according to claim 11, wherein the fibre material of the sheath is selected from the group consisting of high-strength high-modulus polyethylene fibres, liquid crystal (LC) polyester fibres, other abrasion resistant polyester fibres, polyamide fibres and mixtures thereof.

* * * * *